US006343529B1

(12) United States Patent
Pool

(10) Patent No.: US 6,343,529 B1
(45) Date of Patent: Feb. 5, 2002

(54) FAN CLUTCH WRENCH KIT

(75) Inventor: James L. Pool, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 09/698,119

(22) Filed: Oct. 27, 2000

(51) Int. Cl.[7] ..... B25B 9/00
(52) U.S. Cl. ..... 81/13
(58) Field of Search ..... 81/13, 55, 487, 81/52

(56) References Cited

U.S. PATENT DOCUMENTS 1,261,006 A * 4/1918 Bartelt ..... 81/13
1,406,331 A * 2/1922 Bartelt ..... 81/13
2,645,960 A * 7/1953 Pray ..... 81/13
2,952,178 A * 9/1960 Buchheim ..... 81/13
3,094,020 A * 6/1963 Wise ..... 81/13

OTHER PUBLICATIONS

Lisle Corp. catalog, 1997, p. 44, Item No. 41800—Fan Clutch Wrench Set for Ford.
KD Corp. catalog, Nov. 1997, Item No. 3472—Fan Clutch Wrench Kit.

* cited by examiner

*Primary Examiner*—Eileen P. Morgan
*Assistant Examiner*—Joni B. Danganan
(74) *Attorney, Agent, or Firm*—Banner & Witcoff, Ltd.

(57) ABSTRACT

A universal fan clutch wrench kit includes an adjustable holding wrench and an adjustable turning wrench, both of which are utilized in unison to remove a fan clutch assembly.

7 Claims, 3 Drawing Sheets

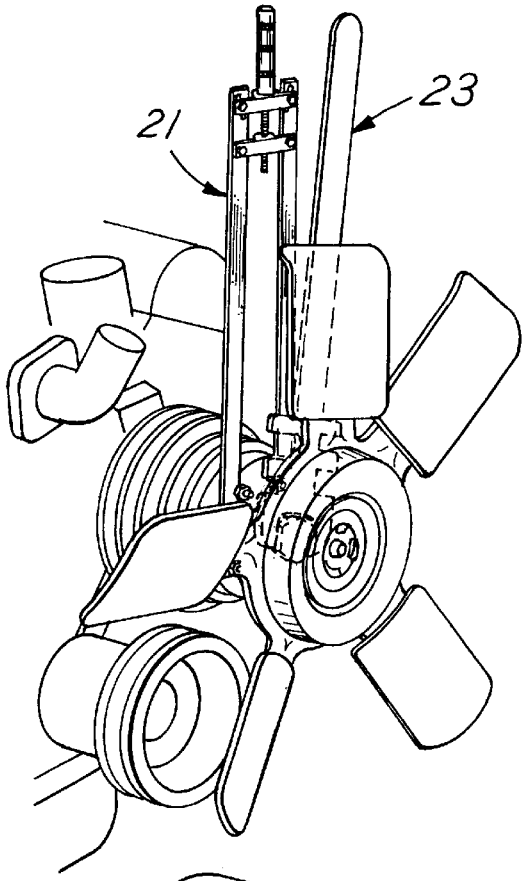
FIG.3
FIG.4
PRIOR ART
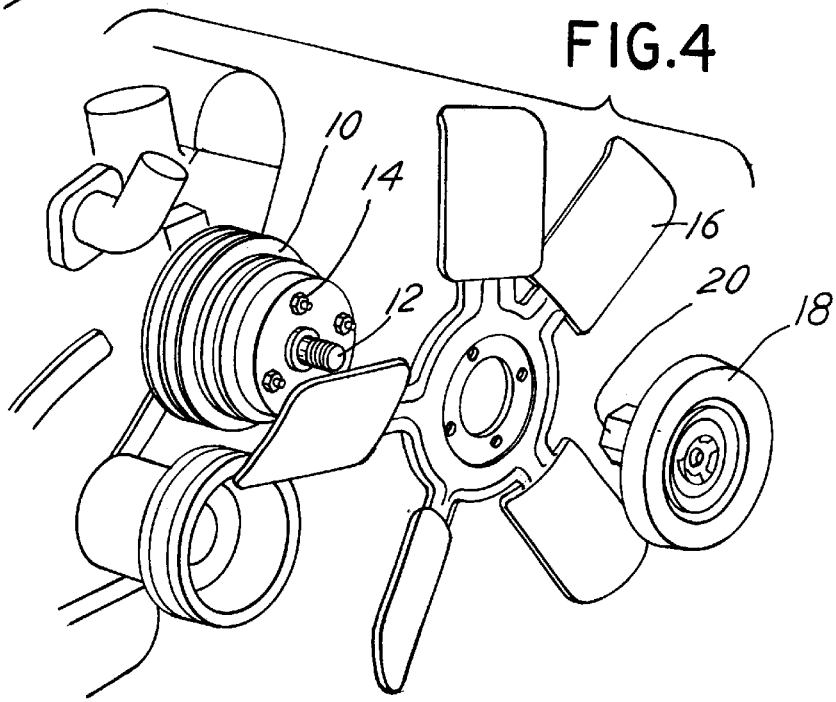

FAN CLUTCH WRENCH KIT

BACKGROUND OF THE INVENTION

This invention relates to a fan clutch wrench kit. A pair of such wrenches may be used, for example, to remove a fan clutch from a water pump pulley shaft for a water cooled internal combustion engine of a vehicle. The wrench kit is comprised of first and second flat profile wrenches, one of which includes adjustable jaws at one end and one of which has multiple size openings which together are operable in tandem to facilitate the removal or installation of a fan clutch.

Heretofore, when removing a fan clutch from various models of internal combustion engines, it has been the practice to provide two wrenches which work in tandem including a first wrench having a pair of fixed, spaced parallel jaws compatible with the spacing of retention nuts for a water pump pulley hub or housing. This first wrench is typically known as a holding wrench. The second wrench is a flat stock, open ended working wrench having a pair of fixed, spaced, parallel jaws sized to engage and effect the loosening of a hexagonal nut which holds the fan clutch in place. Use of two such described wrenches is often required when repairing or replacing a water pump, timing chain, or the fan clutch itself.

The wrenches are typically relatively thin in order to fit into a constricted space between a water pump hub or pulley and the fan clutch housing of a vehicle engine. Moreover, because different vehicles utilize distinctly sized and positioned fastening nuts, multiple fixed jaw wrenches are required to service each one of various model vehicles.

Thus a collection of wrenches is required to currently service the many models and makes of vehicles which utilize the fan clutch assembly described. In other words, the use of a wrench set or kit comprising a single holding wrench and a single working wrench is not adequate for universal use in the field. The present invention contemplates utilization of a universal clutch wrench kit and is comprised of one holding wrench and one working wrench which together may be used for various sizes and styles of fan clutch assemblies.

SUMMARY OF THE INVENTION

Briefly, the present invention comprises a wrench kit which includes a first or holding wrench and a second working or turning wrench. The first or holding wrench includes first and second substantially identical opposed arms, each arm having a gripping end slot, an intermediate pivot and an adjustment end with an associated cam mechanism. Yoke members connect the arms and may be adjusted to pivot the arms into engagement with or out of engagement with separate, spaced fasteners on the opposite sides of a pump housing.

The second or turning wrench includes multiple sized wrench openings or jaws formed in a single flat plate with a single handle. A select jaw of the turning wrench is locked into the fan clutch nut. Then the wrenches are turned with respect to each other to loosen the fan clutch nut from the water pump shaft by the turning wrench as the holding wrench maintains engagement with the pump housing.

Thus it is an object of the invention to provide an improved fan clutch wrench kit and a method of removing or replacing a fan clutch assembly.

A further object of the invention is to provide a fan clutch wrench kit comprised of a first or holding wrench and a second or turning wrench wherein each of the wrenches include jaws for use on multiple sizes of fan clutch constructions or assemblies.

Another object of the invention is to provide an improved fan clutch wrench kit wherein the torque associated with utilization of the wrenches comprising the kit may be measured and adjusted by means of cooperative engagement of one of the handles of the holding wrench or turning wrench with a torque measuring device.

Yet a further object of the invention is to provide a fan clutch wrench kit comprising a set of wrenches, wherein the holding wrench has separate moveable jaws and arms which are fabricated from thin, flat steel stock so that the wrench may be easily used in the confined space between a fan clutch and water pump pulley of an internal combustion engine.

Yet a further object of the invention is to provide a fan clutch tool kit or wrench kit comprised of two separate wrenches, namely a holding wrench and a turning wrench, which may be used for a great variety of fan clutch assemblies having various fasteners and nuts which comprise the elements for fastening the assemblies together.

Yet another object of the invention is to provide a fan clutch wrench kit or set which is economical, easy to use and which may be used with a wide variety of fan clutch assemblies.

These and other objects, advantages and features of the invention will be set forth in the detailed description which follows.

BRIEF DESCRIPTION OF THE DRAWING

In the detailed description which follows, reference will be made to the drawing, comprised of the following figures:

FIG. 3 is an isometric view of a typical fan clutch and water pump construction wherein the wrenches of the invention are utilized to effect removal and/or replacement thereof; and FIG. 4 is an exploded isometric view of the fan clutch assembly of FIG. 3 illustrating the component parts with which the wrenches engage during their utilization.

DESCRIPTION OF THE PREFERRED EMBODIMENT

Figure 1:
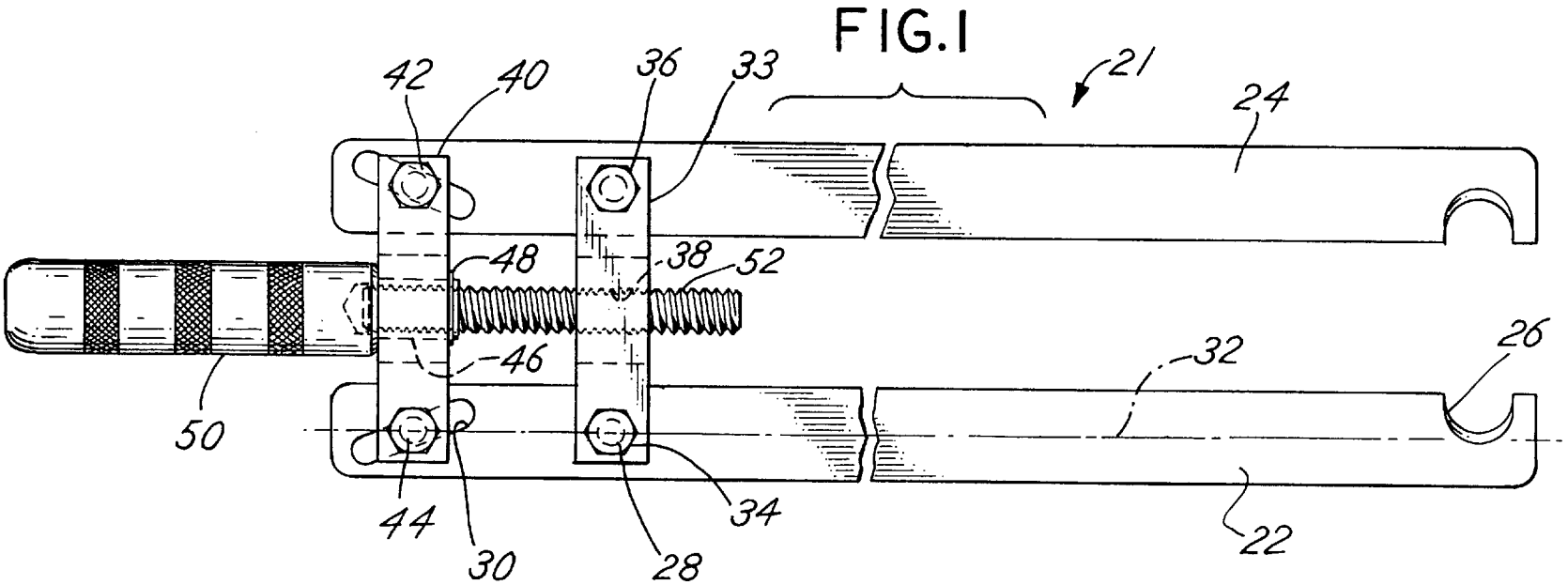
FIG. 1 is a top plan view of a holding wrench used in the practice of the invention.

FIGS. 3 and 4 illustrate a typical environment wherein wrenches comprising the wrench kit of the invention are used. FIG. 4 thus depicts a pulley or hub 10 associated with a vehicle, internal combustion engine water pump, for example. A water pump shaft 12 projects from the hub 10. Four equally spaced bolts 14 are affixed to the hub 10 and radially spaced equidistantly from the centerline axis of the shaft 12.

A fan 16 is affixed to a fan housing 18. The housing 18 includes a housing nut 20 which may be threadably attached to the shaft 12. Because of the spacing within the internal combustion engine compartment of a vehicle, the spacing between the fan 16 and the hub 10 is limited. To remove the fan 16 and its associated housing 18 thus is exceedingly difficult.

Heretofore, a fixed jaw size wrench would fit over the head of bolts 14 or nuts on the outer ends of bolts. A separate fixed jaw size wrench would engage against the housing nut 20. The wrench which engages the nuts 14 is called a holding wrench. The wrench engaging the housing nut 20 is typically called a turning wrench. Such wrenches are generally fabricated from thin metal stock and inserted in the space between the fan 16 and the hub 10 to engage the bolts 14 as well as the housing nut 20. The wrenches are turned or twisted with respect to each other. In this manner, the housing nut 20 may be released from shaft 12 or attached to shaft 12 as the case may be. Because each hub 10 in each internal combustion engine tends to be of different size and configuration and because the positioning of nuts or fasteners 14 varies from vehicle to vehicle, and further because the size and configuration of the housing nut 20 also will vary from vehicle to vehicle, it has been heretofore determined that multiple sets of holding and turning wrenches are required in order to effect or have available the means for removal of a housing nut 20 from shaft 12 for each and every vehicle.

Figure 2:
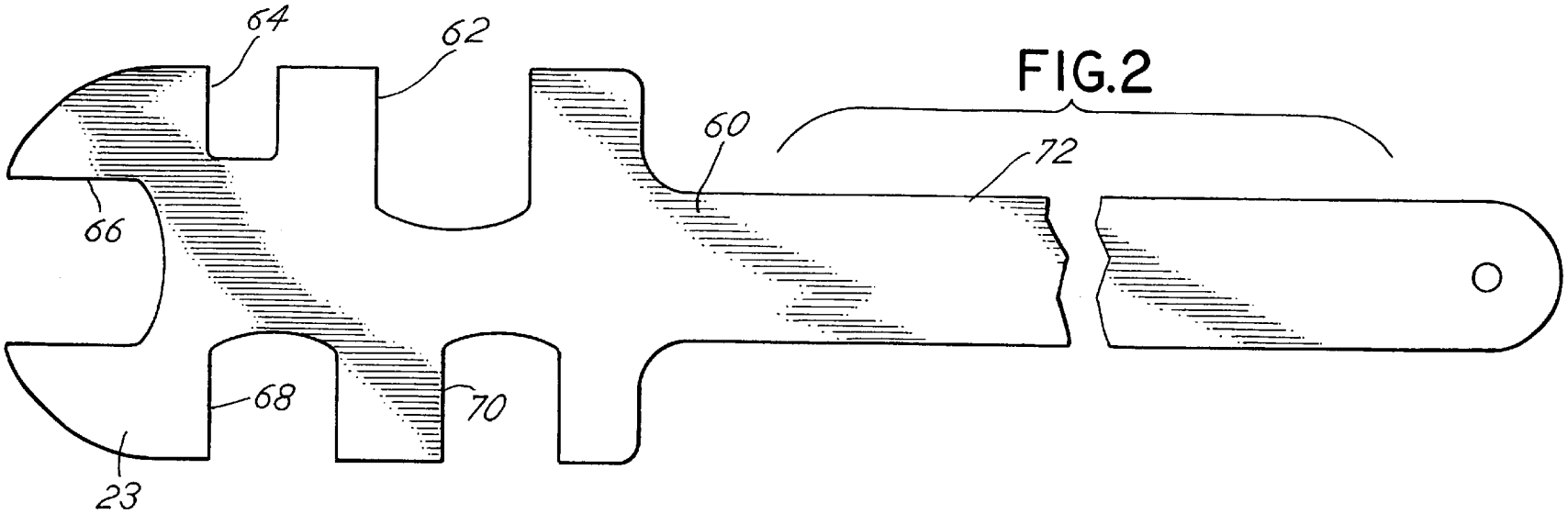
FIG. 2 is a top plan view of a turning wrench used in the practice of the invention.

FIG. 1 illustrates a universal holding wrench 21 which may be used in place of multiple holding wrenches heretofore required. FIG. 2 illustrates a turning wrench 23 which likewise may be utilized in lieu of multiple turning wrenches required heretofore. Both the holding wrench 21 of FIG. 1 and the turning wrench 23 of FIG. 2 are capable of universal application regardless of the size and positioning of bolts (e.g. bolts 14) and the housing nut (e.g. nut 20).

Thus referring to FIG. 1, holding wrench 21 includes a first arm 22 and a second arm 24. The arms 22 and 24 are fabricated from thin metal steel stock. The thickness of the arms 22 and 24 is typically on the order of ⅛" to ¼". The arms 22 and 24 are substantially identical in construction but are arranged as depicted in FIG. 1 in opposed relation as mirror images of each other. Thus the description with respect to arm 22 will apply also with respect to the construction of arm 24.

The arm 22 includes a fastener or nut engaging slot or notch 26 at the distal end. In the embodiment shown, the notch 26 is arcuate in configuration. This enables positioning of the notch 26 over any size and type of headed fastener or nut. The arm 22 is elongate and includes an intermediate pivot 28. A cam mechanism is located at the opposite end of the arm 22 which, in the present circumstance, comprises an inclined slot 30. The slot 30 is inclined to a longitudinal axis 32 of arm 22 and extends toward the notch 26 on the inside of arm 22. The slot 30 is inclined at an angle of approximately 30° with respect to the axis 32. Again, note that arms 22 and 24 thus have an identical construction but are arranged in opposed relationship.

A fixed yoke 33 is attached to the arms 22 and 24 by means of pivot axle pins or bolts 34 and 36. The arms 22 and 24 may thus pivot about the pivot axes defined by the bolts 34 and 36. The yoke 33 includes a threaded central passage or slot 38 therethrough.

At the outer distal end of arms 22 and 24 there is included an adjustable yoke or yoke crossbar 40. Yoke 40 includes pivot pins or shafts 42 and 44 extending through openings in the yoke 40 that project into the slots 30. The bolts 42 and 44 thus serve as followers in the cam slots 30. The yoke 40 may move in the longitudinal direction in order to actuate the arms 22 and 24 and pivot those arms 22, 24 about the pivot pins 34 and 36. As the yoke 40 moves in the longitudinal direction along axis 32 toward fixed yoke 33, the arms 22 and 24 will pivot outwardly at the distal end which includes the slots 26. As the yoke 40 moves in the opposite direction, the arms 22 and 24 will pivot so that the slots 26 will more closely approach each other and grip onto appositely spaced nuts or bolts 14 associated with the fuel pump housing or hub 10.

The yoke 40 further includes a center bushing 46 held in place by an external retaining rig 48. A handle 50 with a threaded shaft 52 is positioned in the bushing 46 and the threaded shaft 52 extends into the threaded passage 38 of yoke 33. Rotation of the handle 50 and bushing 46 will affect threaded shaft 52 to move in threaded passage 38 and thereby drive the yoke 42 longitudinally toward or away from the yoke 32 depending upon the sense of rotation. In this manner, by rotation of the handle 50, the spacing of the slots 26 is effectively controlled and the holding wrench 21 may be affixed or locked onto bolts 14, or released from bolts 14.

In practice, the thin arms 22 and 24 are positioned on opposite sides of fasteners such as bolts 14 in FIG. 4. The handle 50 is then rotated to cause the slots 26 to tightly grip over the spaced bolts or fasteners 14. Also a torque measuring device may be placed over the handle 50 to indicate the load being placed on the handle 50 and thus on the fasteners 14 as the handle 50 is pushed about the axis of shaft 12 or, as will be described below, the relative torque effected when the fan housing nut 20 is removed or replaced.

FIG. 2 illustrates the turning wrench 23 construction. The turning wrench comprises a flat plate 60 with multiple sized jaws 62, 64, 66, 68 and 70 formed at one end onto handle 72 defined at the opposite end. The plate 60 is fabricated from a thin sheet steel alloy. The jaws 62, 64, 66, 68 and 70 may have the configuration of a polygon.

In operation, one of the jaws 62, 64, 66, 68 or 70 is fitted over a nut 20. Then the holding wrench 21 is positioned on nuts 14 and the turning wrench 23 may be manually torqued or turned relative to the holding wrench 21 to tighten the nut 20 or remove the nut 20 from shaft 12. A torque measuring device may be fitted onto handle 72 to measure the torque on the nut 20.

It is possible to vary the construction of the holding wrench and turning wrench and not depart from the spirit and scope of the invention. For example, the shape of the jaws of each of the wrenches may be altered while still maintaining their capability to interact with the bolts insofar as the holding wrench is concerned and with various sizes, shapes and types of nuts by the turning wrench. Additionally, either one of the wrenches 21, 23 may serve a holding or turning function. Further the handles 72 or 50 may be combined with torque measuring apparatus to thereby affect and control the torque applied to the fasteners which are removed or replaced or repaired by the kit of the invention.

Thus while there has been set forth a preferred embodiment of the invention, it is to be understood that the invention is limited only by the following claims and their equivalents.

What is claimed is:

1. A fan clutch tool kit comprising, in combination:

(a) a first holding wrench including first and second arms, said arms having a substantially identical construction with a gripping end and an adjustment end, each arm comprising an elongate, generally flat plate with a notch at the gripping end, an intermediate pivot and a cam mechanism at the adjustment end, said arms transversely spaced by a fixed length yoke member connected to the pivots and an adjustable length yoke mechanism connecting the cam mechanism, said notches in opposed relation to grip separate spaced fasteners therebetween as the adjustable length yoke pivots the arms about their pivots; and (b) a second turning wrench including an elongate plate member having a plurality of variously sized gripping jaws at one end and a handle at the other, opposite end from the gripping jaws, said holding wrench and said turning wrench positionable on a fan clutch assembly for loosening or tightening a fan clutch retainer nut.

2. The kit of claim 1 wherein the cam mechanism of the holding wrench arms include cam slots and the adjustable yoke includes followers in the slots.

3. The kit of claim 1 wherein the holding wrench includes a threaded connection between the yoke member and the yoke mechanism for adjusting the spacing of the yoke members.

4. The kit of claim 1 wherein the holding wrench notches comprise arcuate slots.

5. The kit of claim 1 wherein the gripping jaws of the turning wrench comprise sides of a polygon.

6. A holding wrench for a clutch tool kit comprising, in combination:

first and second flat, elongate plate arms, each arm having a gripping end slot, an intermediate pivot and an adjustment end cam slot, said arms being substantially identical and arranged with the gripping end slots in opposed relation;

a fixed length yoke member attached to the pivots whereby the arms may be pivoted to move the end slots toward or away from each other to grip or release spaced fasteners on a fan clutch assembly;

an adjustable length yoke mechanism including a yoke cross bar and followers on the end of the bar to engage the cam slots; and an adjustable length shaft between the yoke member and yoke mechanism to control the spacing between the yokes and the engagement of the followers in the cam slots to thereby affect pivotal movement of the arms for positioning of the gripping end slots.

7. A method for removing or replacing a fan clutch assembly of the type having at least two bolts on a housing positioned on opposite sides of a shaft with a nut threaded on the shaft, comprising in combination, the steps of:

placing a holding wrench on the two bolts, said holding wrench including first and second arms, each arm having a substantially identical construction including a gripping slot at one end for engaging a bolt, each arm further including an intermediate pivot, and a cam adjustment mechanism for pivoting the arms about their pivot to engage the bolts, said holding wrench further including a fixed length yoke connecting the pivots and an adjustable length yoke mechanism connecting the cam mechanism;

adjusting the spacing of the adjustable yoke mechanism relative to the fixed length yoke to pivot the arms to tightly grip the bolts;

placing a turning wrench on the nut to tightly grip the nut; and pivoting the turning wrench about the shaft while restraining the holding wrench to loosen and remove the nut from the shaft or replace the nut on the shaft as the case may be.

* * * * *